US005261384A

United States Patent [19]

Hu

[11] Patent Number: 5,261,384

[45] Date of Patent: Nov. 16, 1993

[54] TOY GUN WITH A SHOOTING CONTROL STRUCTURE

[76] Inventor: Shih-Che Hu, 2F3R, No. 14, Ching Chung St., Tainan, Taiwan

[21] Appl. No.: 803,487

[22] Filed: Dec. 5, 1991

[51] Int. Cl.[5] ..... F41B 11/00; F41A 19/00; A63H 33/30; A63H 29/22

[52] U.S. Cl. ..... 124/66; 446/484; 446/401; 446/473; 124/16; 124/32

[58] Field of Search ..... 446/473, 475, 483, 484, 446/399, 400, 401; 124/61, 63, 64, 65, 66, 67, 72, 77, 16, 32

[56] References Cited

U.S. PATENT DOCUMENTS

| | | | |
|---|---|---|---|
| 645,932 | 3/1900 | Beck et al. | 124/72 X |
| 1,760,652 | 5/1930 | Loomis | 124/67 |
| 1,830,763 | 11/1931 | Loomis | 124/67 |
| 2,734,310 | 2/1956 | Christopher | 446/473 X |
| 3,818,887 | 6/1974 | Akiyama et al. | 124/67 |
| 4,763,430 | 8/1988 | D'Andrade | 446/473 X |
| 4,770,153 | 9/1988 | Edelman | 124/72 |
| 4,808,143 | 2/1989 | Kuo | 446/473 X |
| 4,848,307 | 7/1989 | Tsao | 124/67 X |

FOREIGN PATENT DOCUMENTS

| | | | |
|---|---|---|---|
| 2326317 | 5/1973 | Fed. Rep. of Germany | 124/67 |
| 12723 | 5/1910 | United Kingdom | 124/66 |

*Primary Examiner*—Robert A. Hafer
*Assistant Examiner*—D. Neal Muir

[57] ABSTRACT

A toy gun with a shooting control structure comprising an operation system, a transmission system, a bullet pushing system, and a shooting system, the operation system having a trigger to make two conductors contact with each other to power a motor in the transmission system to turn a half gear to move a piston in the shooting system, the bullet pushing system having an air valve around a tube at the front of a cylinder in the shooting system for a bullet to be shot through out of the opening of the barrel, the air valve being able to be moved forward to push a bullet in the barrel and also function as the extension of the tube, the shooting system having a cylinder and a tubular piston to extend in the cylinder and to be moved by a rack provided with the piston engaging with and moved by a half gear in the transmission system so as to compress the air in the tube to shoot out a bullet.

3 Claims, 4 Drawing Sheets

TOY GUN WITH A SHOOTING CONTROL STRUCTURE

BACKGROUND OF THE INVENTION

A conventional toy gun utilizes gas or a spring as power source for shooting out a bullet. So a toy gun using gas has a drawback to release gas into the open air to pollute it and to give rise to an accident to hurt a child if the gas is filled improperly. And a toy gun using a spring has a disadvantage of a short shooting distance and of resultant less interesting mood for a child to play with it.

SUMMARY OF THE INVENTION

This invention has been devised to supply a kind of toy gun having a long shooting distance and utilizing electricity instead of gas as its power source so as to avoid poison caused by gas and troublesome operation for filling in gas.

One feature planned in this invention is a half gear used in a transmission system, which has teeth on a half circumference and a smooth surface on the other half circumference. The teeth of the half gear is used for moving a piston to shoot a bullet out.

Another feature planned in this invention is a bullet pushing system, in which a connecting rod is used to move an air valve so as to push a bullet in a bullet passage in a barrel at a proper time and the air valve can function as an extension of a tube provided at the front of an air cylinder so as to allow the bullet be shot out at a proper time.

Another feature is a shooting system, in which a tubular plston in an air cylinder is provided with a rack on the outer lower surface to engage with the half gear in the transmission system so that the piston can be moved back from its original (first) position (waiting) to a second position (shooting) and then be pushed forward to its original position for compressing the air in the cylinder for shooting out a bullet.

One more feature is that a switch is provided to select to shoot only one bullet or one by one continuously at one time.

DETAILED DESCRIPTION OF THE INVENTION

Figure 1:
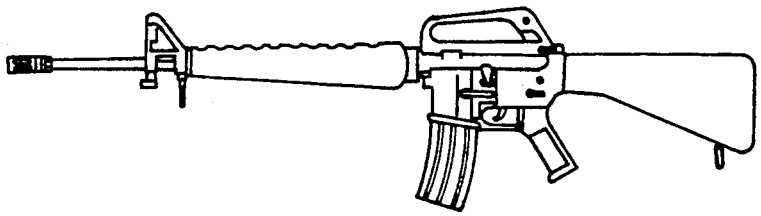
FIG. 1 is a side view of a toy gun with the shooting control structure in the present invention.
Figure 2:
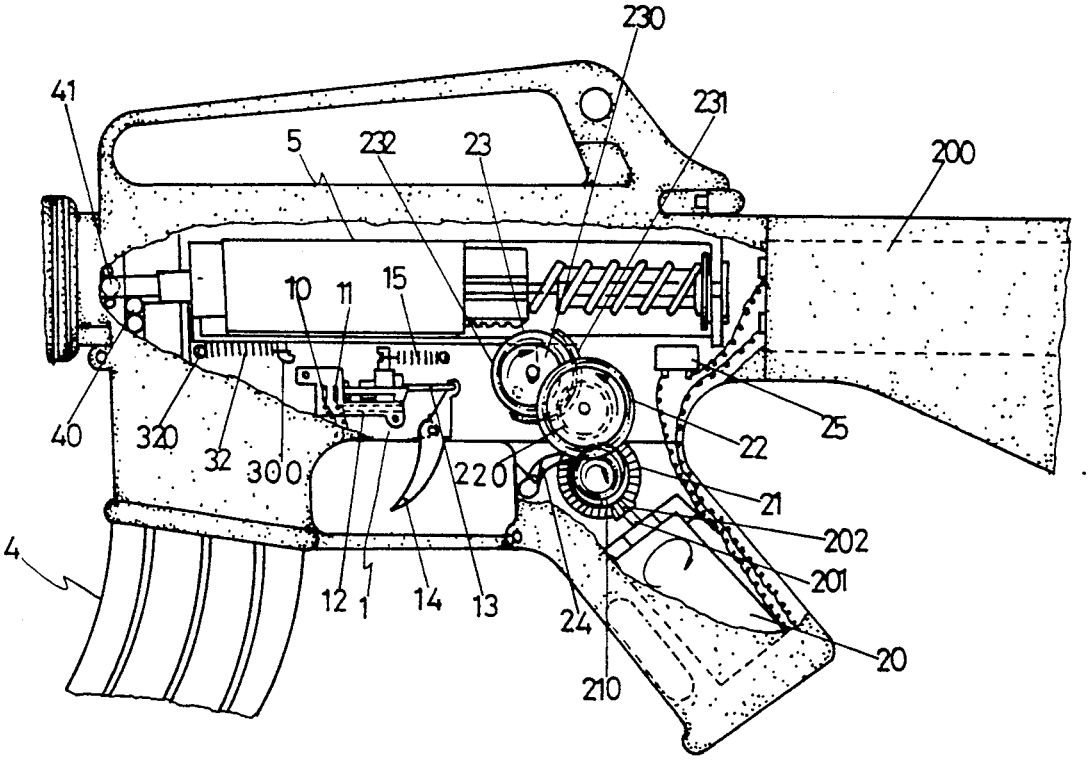
FIG. 2 is a cross-sectional view of a toy gun with the shooting control structure in the present invention.
Figure 3:
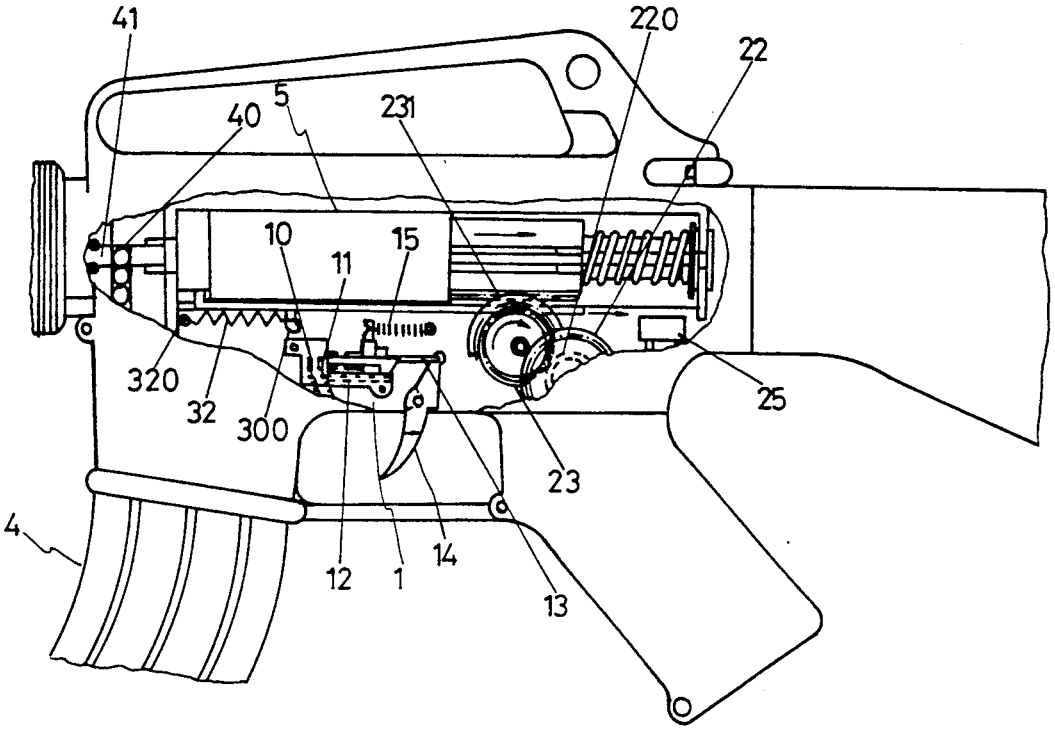
FIG. 3 is a cross-sectional view of loading bullets in a toy gun having the shooting control structure in the present invention.
Figure 4:
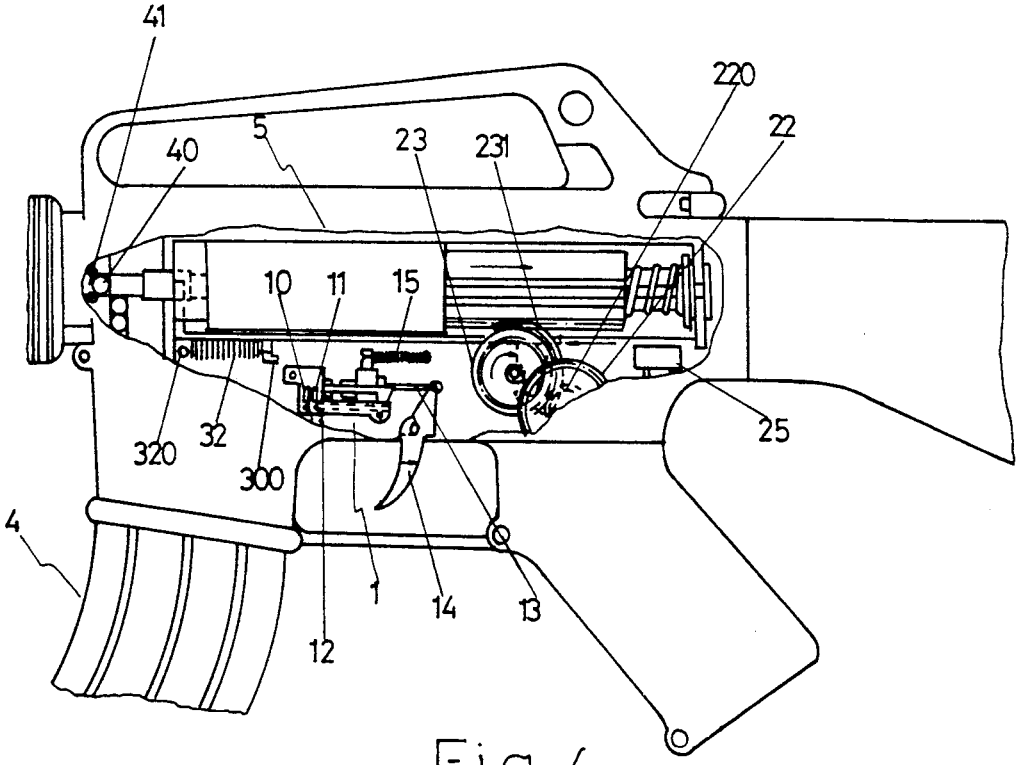
FIG. 4 is another cross-sectional view of loading bullets in a toy gun having the shooting control structure in the present invention.

The toy gun with a shooting control structure in the present invention, as shown in FIGS. 2, 3, 4, comprises an operating system 1, a transmission system 2, a bullet pushing system 3, and a shooting system 5 as its main components.

The operating system 1 has two conductors 10, 11 and the conductor 11 is to be fixed with and moved forward together by a sliding member 12 connected with one end of a small connecting rod 13 having the other end connected with the upper end of a trigger 14 so that when the trigger 14 is pulled back by a finger, the sliding member 12 can be pushed forward by the small connecting rod 13, moving the conductor 11 forward to touch the other conductor 10 to turn on electric power source. Then a motor 20 in the transmission system 2 is powered and begins to rotate. If the trigger is released, the conductor 11 together with the sliding member 12 can pulled back to the original position, leaving the other conductor 10 and cutting off power.

Figure 7:
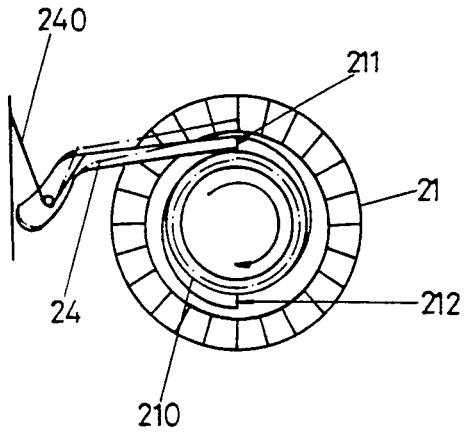
FIG. 7 is a front view of the detent in the toy gun with the shooting control structure in the present invention.

The transmission system 2 includes a motor 20 and a battery unit 200 supplying electric power to the motor 20, and a small bevel gear 202 fixed on the shaft of the motor a large bevel gear 21 to engage with said gear 202, a first small gear 210 formed on the large bevel gear 21 as a unit, a large gear 22 to engage with the first small gear 210, a second small gear 220 formed under the large gear 22 as a unit to engage a gear 230 formed on a half gear 23 having teeth 231 on a half circumference, said half gear engaging with a rack provided on the lower surface of a tubular piston in the shooting system so that the toothed half circumference can move back the piston 51 and the smooth half circumference can serve the piston 51 to be moved forward by a spring 54. In order to prevent the motor 20 from rotating in counter direction owing to the battery unit wrongly put in reverse pole, a detent 24 shown in FIG. 7 is especially provided in the large bevel gear 21, supported and controlled by a twisting spring 240 so that said spring 240 can press down the detent 24. In addition, the first small gear 210 is provided with two stop surfaces 211, 212 to stop the first small gear 210 from rotating in counter direction so that the motor 20 can also be stopped and the power can be automatically cut off.

A selecting switch 25 is provided to select to shoot one bullet at one time or one by one continuously at one time.

Figure 5:
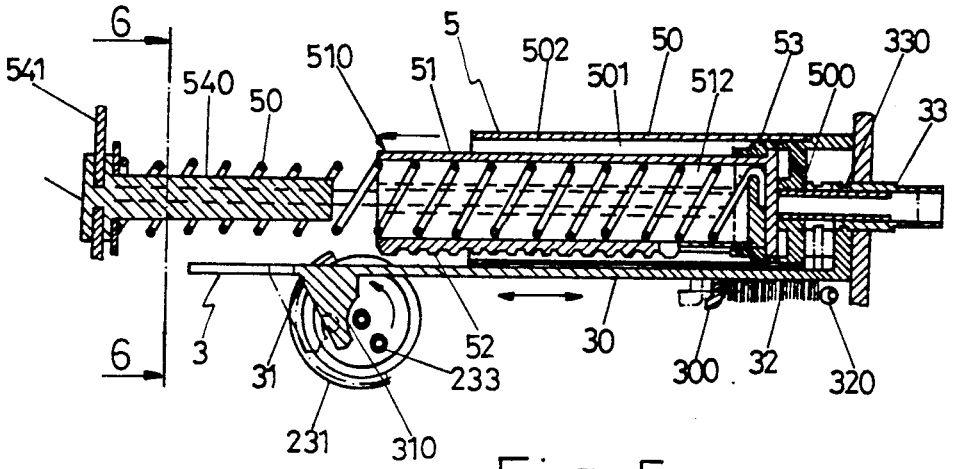
FIG. 5 is a cross-sectional view of the shooting structure in the toy gun with the shooting control structure in the present invention.

The bullet pushing system 3 includes a big connecting rod 30 having an actuating member 31 of an irregular shape extending down from the rear portion and a side surface 310 on the actuating member 31. The actuating member 31 can be moved, as shown in FIG. 5, by a sidewise post 233 provided on a side surface of the half gear 23 so that the big connecting rod 30 can be pushed back by the post 233 when the half gear 23 rotates. The connecting rod 30 also has a hook 300 at the front portion to hook one end of a spring 32 having the other end fixed on a fixing post 320 so that the connecting rod 30 can be pulled back to its original position (waiting) by the spring 32. The right-hand end (as viewed in FIG. 5) of the big connecting rod 30 is bent upright through 90° and is of forked shape to engage an annular groove 330 of an air valve 33 so that the rod 30 can move back and forth the air valve 33 provided around a tube 500 provided at the front of the cylinder 50. When the connecting rod 30 is pulled back to a second position (shooting) as shown in FIG. 3, the bullet 40 in the bullet case 4 is to be pushed in the bullet passage 41. When the rod 30 is pushed forward to its original (the first) position, the air valve 33 can be pushed forward to push the bullet to the front of the bullet passage 41 to become ready to be shot out. So the air valve 33 functions as the extension of the tube 500 to keep the air pressure in the barrel.

Figure 6:
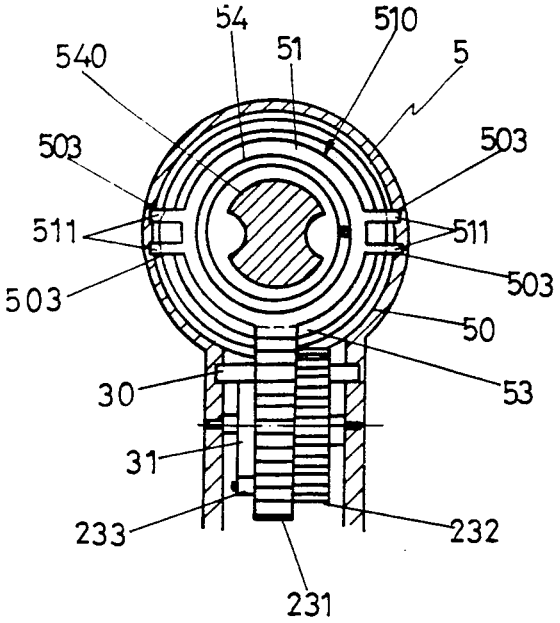
FIG. 6 is a cross-sectional view of A—A line in FIG. 5.

The shooting system 5 shown in FIGS. 5, 6 includes a cylinder 50 and a tubular piston 51 provided to extend in a hollow passage 501 in the cylinder 50. The cylinder 50 has two grooves 503 in the inner wall surface 502 as shown in FIG. 6 for sliding rails 511 on the outer surface 510 of the piston to fit and slide therein. The piston 51 has a rack 52 on the outer lower surface 510 to engage with the half gear 23 for mutual movement.

The number of the teeth of the rack 52 is the same as that of the teeth 231 of the half gear 23 so that the piston 51 can be pushed back by the rack 52 when the half gear 23 rotates. A rubber gasket 53 is provided at the front end of the piston 51 to rest on the inner surface 502 of the cylinder 50 to push the air in the cylinder 50.

A powerful spring 54 is provided to extend in the hollow cavity 512 of the piston 51, having one end fixed at the front of the piston 51 and the other end fixed on a position rod 540, which is caught in a hole 542 of a position plate 541 so that the movement of the piston 51 and the elasticity and movement of the spring 54 can be kept constant, so as to highten shooting accuracy, and to prevent biasing of the piston 51.

What is claimed is:

1. A toy gun with a shooting control structure comprising;

an operating system having two electric conductors, a sliding member being fixed with one of the conductors and having a connecting rod fixed with a upper end of a trigger, and a spring fixed with the sliding member, said trigger having a first position for waiting and a second position for shooting a bullet out by making the sliding member move to let the two conductors contact with each other, said sliding member being in the first position for waiting and in the second position for shooting as the trigger is pulled, said trigger being able to be pulled by finger from the first position to the second position, said spring being able to pull the sliding member back from the second position to the first (original) position if the trigger is released;

a transmission system having a motor, a battery unit to supply electric power to the motor to rotate a gear unit including a small bevel gear fixed on a shaft of the motor, a large bevel gear to engage with the small bevel gear, a first small gear formed on the large bevel gear as one unit to engage with a large gear, a second small gear formed under the large gear as one unit, a gear to engage with the second small gear, and a half gear formed under the gear to engage with a rack provided on a lower surface of a piston in a shooting system for mutual movement, said half gear having gear teeth on a half circumference, a smooth half circumference and a sidewise post, said half gear being indirectly rotated by the motor to move the piston;

a bullet pushing system including a big connecting rod provided below along a cylinder in a shooting system, said connecting rod having (1) an actuating member extending down from the front portion to be pushed by the sidewise post of the half gear so that the big connecting rod can be moved from a original (first) position to a second position (for shooting), (2) a spring to pull back the big connecting rod to its original position (the first position), and (3) a bent-upright front portion having a forked end to fit in an annular groove in an air valve fixed around a tube provided at the front of the cylinder so that the air valve can be moved forward to the second position from the first position as the connecting rod is moved backward, and a bullet can be pushed in a shooting passage in the tube at the front of the cylinder;

a shooting system including (1) a cylinder having two grooves in its inner wall, (2) a tubular piston extending in the cylinder and having two sliding rails on the outer surface to fit in the sliding grooves in the cylinder so as to slide therein and a rubber gasket at the front end for resting on an inner surface of the cylinder so as to compress the air in the cylinder, said piston also having a rack extending down from the lower surface to engage with the half gear in the transmission system so that said piston may be moved by the half gear from the first position (waiting) to the second position (shooting), and (3) a powerful coiled spring provided in the inner cavity of the piston with one end fixed in front of the piston and with its other end fixed on a position rod behind the piston to push back the piston from the second position to the first position after a bullet has been shot out.

2. The toy gun with a shooting control structure as claimed in claim 1, wherein said large bevel gear is provided with a detent to coordinate with two stop surfaces in the second small gear to prevent counter rotation of the motor.

3. The toy gun with a shooting control structure as claimed in claim 1, wherein the number of the teeth in the half gear in the transmission system is the same as that of the teeth in the rack of the piston in the shooting system.

* * * * *